US005185981A

United States Patent [19]

Martinez

[11] Patent Number: 5,185,981

[45] Date of Patent: Feb. 16, 1993

[54] ABUTMENT OF INSULATING PANELS

[75] Inventor: Joaquin L. Martinez, Pamplona, Spain

[73] Assignee: Perfil en Frio, S.A., Spain

[21] Appl. No.: 827,562

[22] Filed: Jan. 28, 1992

Related U.S. Application Data

[63] Continuation of Ser. No. 439,627, Nov. 20, 1989, abandoned.

[51] Int. Cl.[5] ..... E04B 5/52

[52] U.S. Cl. ..... 52/578; 52/461; 52/584; 52/309.9

[58] Field of Search ..... 52/309.9, 584, 461, 52/601, 309.11, 578

[56] References Cited

U.S. PATENT DOCUMENTS

| | | | |
|---|---|---|---|
| 1,644,710 | 10/1927 | Crooks | 52/578 |
| 1,854,396 | 4/1932 | Davis | 52/601 X |
| 2,103,152 | 12/1937 | Douglass | 52/578 |
| 2,142,305 | 1/1939 | Davis | 52/601 X |
| 2,257,001 | 9/1941 | Davis | 52/601 |
| 2,280,071 | 4/1942 | Hamilton | 52/578 |
| 2,438,079 | 3/1948 | Sweet | 52/578 |
| 2,786,241 | 3/1957 | Garvey et al. | 49/498 X |
| 2,808,624 | 10/1957 | Sullivan | 52/584 |
| 2,858,582 | 11/1958 | Toulmin | 52/578 |
| 2,896,271 | 7/1959 | Kloote | 52/578 X |
| 2,947,040 | 8/1960 | Schultz | 52/578 X |
| 2,982,380 | 5/1961 | Rose | 52/578 X |
| 2,986,848 | 6/1961 | Greene | 52/601 |
| 3,127,926 | 4/1964 | Adelt | 52/578 X |
| 3,283,462 | 11/1966 | Gregoire | 52/588 X |
| 3,479,784 | 11/1969 | Massagli | 52/806 X |
| 3,535,844 | 10/1970 | Glaros | 52/309.9 |
| 3,566,568 | 3/1971 | Slobodian | 52/309.9 |
| 3,608,260 | 9/1971 | Eckel et al. | 52/588 X |
| 3,638,384 | 2/1972 | Martin | 52/601 X |
| 3,760,548 | 9/1973 | Sauer | 52/578 X |
| 4,037,377 | 7/1977 | Howell et al. | 52/309.9 |
| 4,104,840 | 8/1978 | Heintz et al. | 52/309.9 |
| 4,125,301 | 11/1978 | Quy Phan | 52/309.11 X |
| 4,244,151 | 1/1981 | Seem | 52/309.9 |
| 4,435,935 | 3/1984 | Larrea | 52/461 |
| 4,589,240 | 5/1986 | Kendall et al. | 52/309.11 |
| 5,031,375 | 7/1991 | Martinez | 52/584 |

FOREIGN PATENT DOCUMENTS

| | | | |
|---|---|---|---|
| 2445180 | 4/1976 | Fed. Rep. of Germany | 52/309.9 |
| 2800811 | 7/1979 | Fed. Rep. of Germany | 52/788 |
| 3416511 | 11/1985 | Fed. Rep. of Germany | 52/407 |
| 172109 | 7/1960 | Switzerland | 52/578 |
| 991754 | 5/1965 | United Kingdom | 52/578 |
| 1595180 | 8/1981 | United Kingdom | 52/309.9 |

*Primary Examiner*—James L. Ridgill, Jr.
*Attorney, Agent, or Firm*—Lucas & Just

[57] ABSTRACT

A joint for insulating panels is disclosed. Each panel has an exterior metal plate and an interior metal plate, between which an insulating filling material is inserted. One end of the interior metal plate has a depression which extends along a flange towards the interior of the panel. The other end of the interior metal plate has a projection corresponding to the depression, the projection extending along a flange towards the interior of the panel. The relationship between the height of the depression/projection (B) and the thickness of the panel (A) is $$\frac{A}{3} \leq B \leq \frac{2}{3} A$$

At least one of the surfaces of the panels abutting each other has an elastic isolating element positioned between the exterior metal plate and one of the flanges of the interior metal plate.

2 Claims, 2 Drawing Sheets

FIG. 1
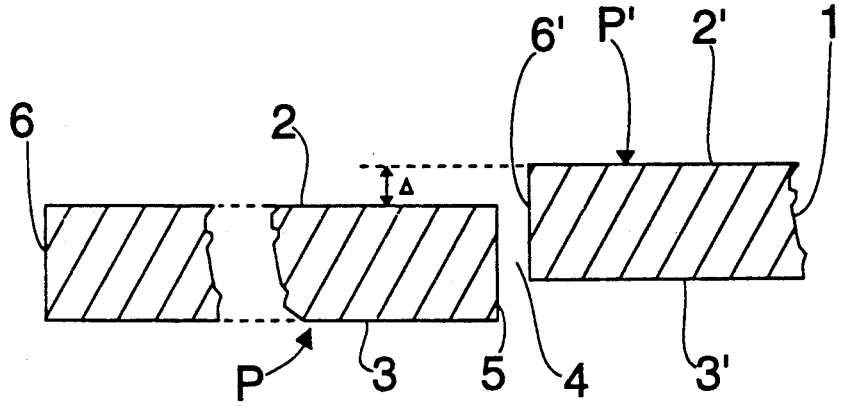
PRIOR ART
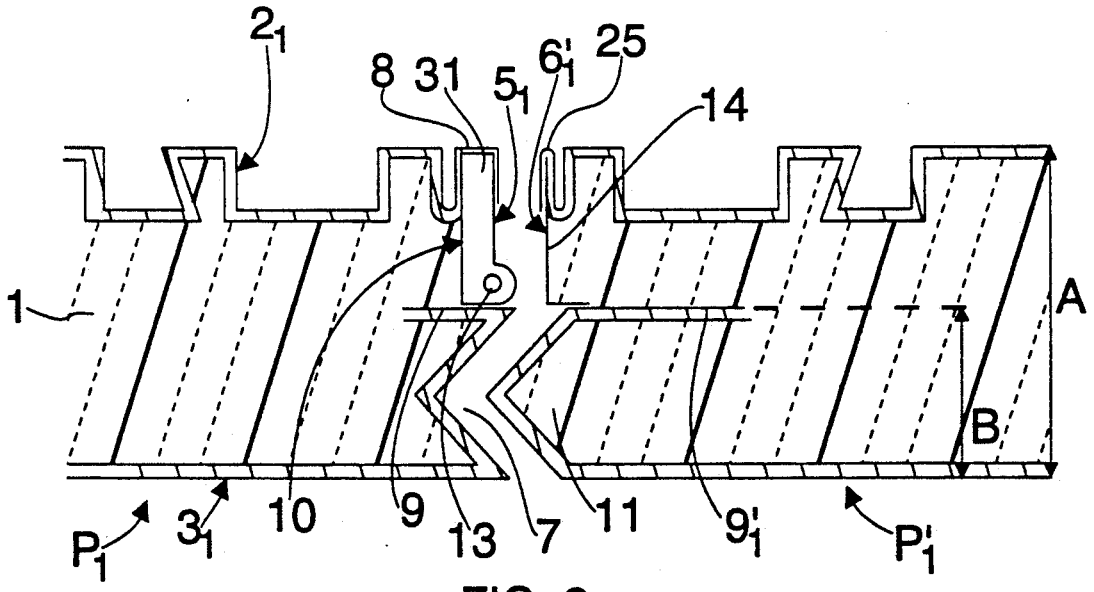
FIG. 2

ABUTMENT OF INSULATING PANELS

This is a continuation of application Ser. No. 439,627, filed Nov. 20, 1989, now abandoned.

BACKGROUND OF THE INVENTION

Field of the Invention

For some time now, the interiorexterior insulation of warehouses, refrigerators, industrial plants, etc., has been achieved by the use of insulating panels consisting of a metal plate on the exterior and a metal plate on the interior with the gap filled with insulating material, usually of a cellular type.

Different techniques for abutting the insulating panels are also known.

Up until now, these techniques have suffered from two basic faults which may occur together or separately:

a) sometimes, due to faults in the panels or their assembly, perfect abutment is not achieved and a gap results between the joining surfaces of the abutting panels.

b) at assembly time, the surfaces remain abutted but the internal and external surfaces become dislocated, neither coplanar or overlapping.

Consequently, the abutment is not perfect and deficiencies in the thermic-acoustic insulation occur; vapours and smoke escape which increases the possibility of a fire.

SUMMARY OF THE INVENTION

Both faults cause both imperfect insulation and also many problems when other assembly workers want to attach the panels one to another, or want to attach covers for aesthetic reasons so that the joins cannot be seen from the outside. The attaching elements and covers come in pre-determined shapes and sizes from the factory and cannot be adjusted to the reality of imperfect coupling.

In order to overcome these problems, the applicant has developed joint means for insulating panels, in which each panel consists of a metal exterior plate and a metal interior plate between which an insulating filling material is inserted, on each side of which there is an abutment with the adjoining panel. Between each panel surface there is a labyrinth zone and in order to form this the interior metal plate consists of:

a) an extension at one end towards the abutment end surface with a depression that extends along first a flange towards the interior of the panel.

b) an extension of the other end towards the other abutment end surface which has a projection which extends along a second flange towards the interior of the panel. The ratio between the height of the labyrinth zone consisting of the depression/projection (B) and the thickness of the panel is $$A/3 \leqq B \leqq \tfrac{2}{3}A$$

and at least one of the joining surfaces has an elastic isolating element positioned between the exterior metal plate and one of the first or second flanges in the interior metal, plate.

BRIEF DESCRIPTION OF THE DRAWINGS

FIG. 1 shows a diagrammatic view of the abutment of two panels using known techniques and illustrates problems that may arise.

FIG. 2 shows a sectional diagrammatic view of a practical embodiment of the invention with smooth panels.

Figure 3:
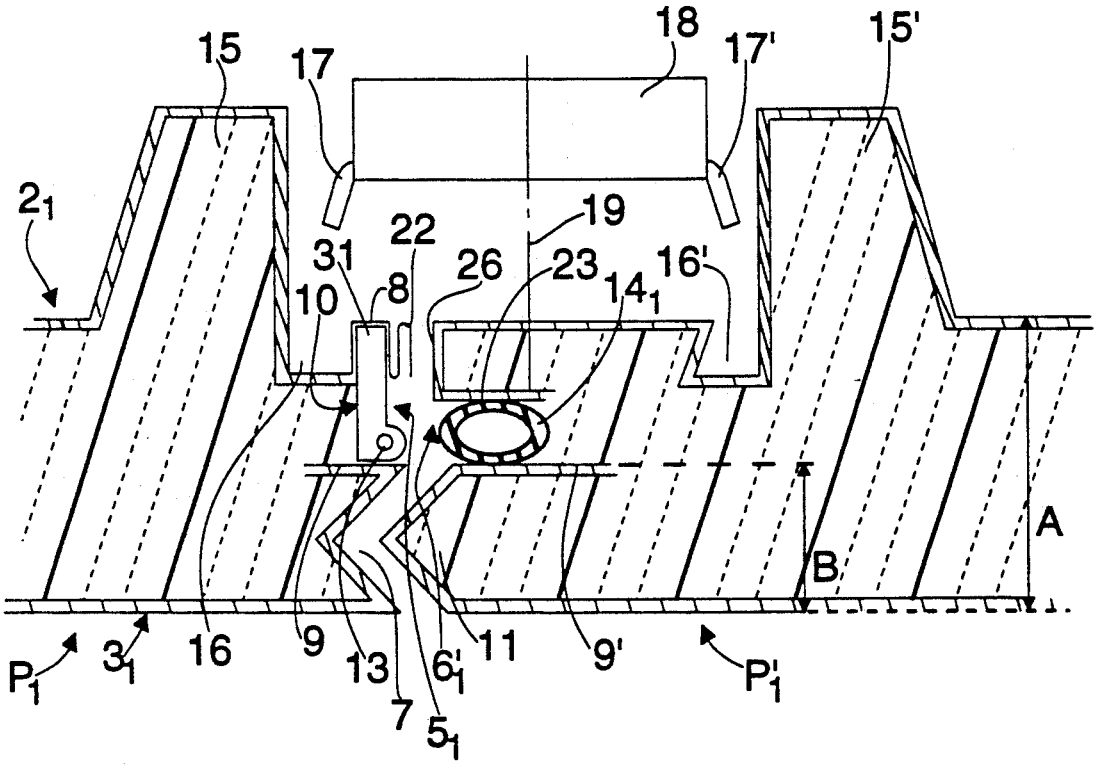
FIG. 3 shows a sectional diagrammatic view of a practical embodiment of the invention with ribbed panels (15), (15').

A conventional panel (P), (P') consists of an external metal plate (2), an internal metal plate (3) between, an exterior metal plate ($2_1$) and insulating material (1) therebetween. Interior metal plane ($3_1$) is placed on insulating material (1) with synthetic foam, cellular material, etc.

Each panel has two abutment end surfaces (5), (6) which are abutted to the corresponding surfaces (6') of the adjoining panels.

The abutment may have two fundamental deficiencies:

a) there is a gap (4) between the panels;

b) the panels are not coplanar and there is a shift ( ) between the corresponding surfaces (51) (2), (2') and (3), (3').

The thickness of the panels in FIGS. 1 and 2 may be similar but for an illustrative purpose, the panels in FIG. 2 are shown with greater thickness.

Description of the Preferred Embodiment

As can be seen in FIG. 2, panel ($P_1$) has an interior metal plate ($3_1$) which extends into the abutment end surface where there is a triangular shaped depression (7) with dimension (B) at its base.

An external metal plate ($2_1$) has a housing (8) at one end where the head (51) of the elastic element (10), for example, a weather-strip, is held. The elastic element remains in position between the aforementioned housing (8) and a return flange (9) towards the interior of the panel from the inner edge of the depression (7) of the interior metal plate (51).

The part of the elastic element (10) which is not positioned in the housing faces the abutment end surface ($6'_1$) of the adjoining panel. It is normally submitted to deformation when both panels are forced together.

In order to facilitate the aforementioned deformation, the elastic element (10) has a proturberance (13) which becomes more out of shape than the rest of the elastic element because it is hollow.

The external metal plate ($2_1$) has a fold (25) at the other end of the panel where, in order to achieve further retention and insulation, a sheet (14) extends from the return flange ($9'_1$) to the projection (11). This sheet (14) has the properties of being impermeable and flameproof and anti-damp, for example, a sheet of aluminium foil which may be impregnated.

The other abutment end surface, not shown, of the panel ($P_1$) is identical to the abutment end surface shown of the panel ($P'_1$) which faces it.

In the abutment end surface ($6'_1$), a triangular shaped projection (11) can be seen which fits together with the depression (7).

The dimensions of the depression (7) and the projection (11) should preferably be comparable with the dimensions of the joint. If the general thickness of the panel is A, then the ratio with dimension (B) of the base of the triangle is approximately within the limits of:

A/3≦B≦⅔A and in this way, according to experiments carried out, the objectives sought after are fulfilled.

Each end of the panel ($P_1$) may have a housing (8) and a weather-strip (10) or elastic element positioned between the corresponding housing and the return flanges (9), (9') of the depression (7) and the projection (11).

In another case, both ends of the exterior metal plate ($2_1$) have folds (25) and sheets (14) of the same or different materials, at least one of which has a protuberance similar to the protuberance (13) of the aforementioned elastic element (10).

In FIG. 3, the elastic element (10) that can be seen at one end of the housing (8) is similar in shape and function to that described in FIG. 2.

At the other end of the panel, the external metal plate ($2_1$) has a first exterior flange (26) leading towards the interior of the abutment end surface ($6'_1$) and at second exterior flange (23) from the anterior and leading towards the interior of the panel ($P_1$).

Between the second exterior flange (23) of the exterior metal plate ($2_1$) and the return flange (9') or the extension of the projection (11) of the interior metal plate ($3_1$), there is a second elastic element ($14_1$) which, in this case, is a hollow tube made of a flexible material such as rubber.

Both elastic elements (10), ($14_1$) face each other and change shape to give the joint flexibility.

Both ends of the exterior metal plate ($2_1$) may be of similar disposition to that described with a first exterior flange (26), a second exterior flange (23) and a flexible elastic element ($14_1$) with, for example, two rubber tubes facing each other which would change shape when the panels were abutted to each other.

The exterior metal plate ($2_1$) has ribs (15), (15') at the proximity of each end, positioned at different distances from the corresponding, abutment end surfaces ($5_1$) ($6'_1$) or their ends.

Between the ribs (15), (15') and the housing (8) and rib (15), the exterior plate ($2_1$) has some recesses (16), (16') where the wings (17), (17') of a staple (18) enter to join and attach the panels ($P_1$), ($P'_1$) to each other.

The staple (18) is screwed at (19) to one of the panels ($P'_1$).

Depending on manufacture needs, the exterior plate ($2_1$) may have a fold (22) extending from the housing (8) and, if necessary, another similar fold at the other end.

It is obvious that the solutions for the abutment described in FIG. 2 are interchangeable and may be combined with the solutions in FIG. 3 and vice versa.

I claim:

1. A plurality of insulating panels, each said panel comprising an exterior metal plate, an interior metal plate, insulating material between the said interior and exterior metal plates and first and second abutment means at opposed ends of each panel, (1) said first abutment means comprising
- a first flange,
- a depression on said first flange, said depression being triangular shaped and having legs and one leg of said triangular shaped depression extending immediately from said interior metal plate inwardly towards the interior of the panel, (2) said second abutment means comprising
- a second flange,
- a projection on said second flange, said projection being triangular shaped and having legs which complement the legs of the triangle shaped depression on said first flange and
- said projection extending immediately from said interior metal plate, and said projection being capable of being operatively interconnected in the depression in the end of an adjacent panel, (3) each said abutment means having a width between one-third and two-thirds of the width of said panel, (4) the first and second abutment means of adjacent panels being operatively interconnected to form a labyrinth zone between said adjacent panels, (5) at least one end of each panel further comprising an elastic element positioned between the exterior metal plate and the abutment means, one end of said elastic element being retained in a housing in the exterior metal plate and said elastic element having a hollow protuberance at the other end thereof which sealingly engages the abutting ends of adjacent panels when they are interconnected.

2. The plurality of insulating panels of claim 1 further comprising means for joining said adjacent insulating panels, said means for joining comprising
- a recess in the exterior metal plate of the panel towards each end thereof and
- a clip for joining adjacent panels, said clip having legs for operatively interconnecting adjacent panels by engaging the said recesses in the exterior metal plate of adjacent panels.

* * * * *